US005362621A

United States Patent [19]

Obi et al.

[11] Patent Number: 5,362,621

[45] Date of Patent: Nov. 8, 1994

[54] DIRECT POSITIVE SILVER HALIDE PHOTOGRAPHIC MATERIAL AND METHOD FOR FORMING HIGH CONTRAST POSITIVE IMAGE USING THE SAME

[75] Inventors: Naoki Obi; Kiyoshi Suematsu, both of Tokyo; Yasuhiko Kojima, Saitama; Masatoshi Katayama, Saitama; Yasuo Shigemitsu, Saitama, all of Japan

[73] Assignee: Dainippon Ink and Chemicals, Inc., Tokyo, Japan

[21] Appl. No.: 107,893

[22] Filed: Aug. 18, 1993

[30] Foreign Application Priority Data

Aug. 20, 1992 [JP] Japan ..... 4-221404
Mar. 5, 1993 [JP] Japan ..... 5-045128

[51] Int. Cl.[5] ..... G03C 1/485

[52] U.S. Cl. ..... 430/596; 430/378; 430/411; 430/440; 430/587; 430/600; 430/613

[58] Field of Search ..... 430/597, 596, 598, 440, 430/600, 613, 378, 412, 480, 380, 411

[56] References Cited

U.S. PATENT DOCUMENTS 3,945,832 3/1976 Shiba et al. .
4,273,862 6/1981 Yoshida et al. .

FOREIGN PATENT DOCUMENTS 54-4118 1/1979 Japan .

*Primary Examiner*—Thorl Chea
*Attorney, Agent, or Firm*—Armstrong, Westerman, Hattori, McLeland & Naughton

[57] ABSTRACT

A direct positive silver halide photographic material and a method for forming a high contrast image using the same are disclosed, in which a pre-fogged direct positive silver halide emulsion layer contains a salt of a nitrogen-containing compound having at least one pyridine nucleus and at least one pyridinium nucleus. The photographic material, after imagewise exposure, is developed with an alkaline developer containing a developing agent, preferably a reductance compound. The photographic material provides high contrast characteristics having a gamma exceeding 10.

36 Claims, No Drawings

DIRECT POSITIVE SILVER HALIDE PHOTOGRAPHIC MATERIAL AND METHOD FOR FORMING HIGH CONTRAST POSITIVE IMAGE USING THE SAME

FIELD OF THE INVENTION

This invention relates to a pre-fogged direct positive silver halide photographic material and a method for forming a direct positive using the same. More particularly, it relates to a direct positive silver halide photographic material which provides an extremely high contrast positive image suitable for a photomechanical process for printing in the graphic arts and to a method for forming a high contrast positive image using the photographic material.

BACKGROUND OF THE INVENTION

A direct positive silver halide photographic material can be obtained by using a previously light-fogged or chemical-fogged emulsion taking advantage of solarization. For example, addition of an electron acceptor to a silver halide photographic emulsion having been fogged by a reducing agent combined with a metallic compound affords a direct positive silver halide photographic emulsion as described, e.g., in British Patent 723,019 and U.S. Pat. No. 3,501,307.

Known electron acceptors to be added to a fogged emulsion include pyridinium or bipyridinium salt derivatives as described in British Patents 871,938, 873,937 and 875,887, U.S. Pat. Nos. 3,583,870 and 3,945,832, and JP-B-56-47544 (the term "JP-B" as used herein means an "examined Japanese patent publication"); 4-nitropyridine oxide as described in British Patent 905,237; nitro-substituted benzimidazole as described in British Patent 907,367; nitrophenyl-containing thiazoline-2-thion compounds as described in U.S. Pat. No. 3,367,779; cyanine dyes having an indole nucleus as described in U.S. Pat. Nos. 2,930,694, 3,314,796, 3,501,310, 3,501,311, 3,501,312, 3,505,070, and 3,687,675, and British Patent 970,601; dyes containing an imidazo[4,5b]quinoxaline nucleus as described in U.S. Pat. No. 3,431,111; cyanine dyes having a desensitizing substituent, such as a nitro group, on their two heterocyclic nuclei as described in British Patent 723,019; quaternarized merocyanine dyes as described in U.S. Pat. Nos. 3,539,349 and 3,574,629; pyrylium, thiapyrylium and selenapyrylium dyes as described in U.S. Pat. No. 3,579,345; cyanine dyes containing a 4-pyrazole nucleus as described in U.S. Pat. No. 3,615,608; polymethine dyes containing an imidazole nucleus as described in U.S. Pat. No. 3,615,639; and trinuclear tetramethine cyanine dyes as described in JP-B-1-13091.

IN the field of a photomechanical process where formation of a sharp dot image or line image is required, an image formation system providing extremely high contrast photographic characteristics (gamma of at least 10) is demanded. However, the above-mentioned direct positive silver halide photographic material having added thereto an electron acceptor, though exhibiting high sensitivity, has only achieved a low contrast, failing to form a satisfactory dot image or line image.

In order to eliminate the above disadvantage, various image formation systems have been proposed to date. For example, U.S. Pat. No. 3,615,517 proposes a system comprising developing a pre-fogged silver halide photographic material having added thereto an organic electron acceptor whose oxidation potential and reduction potential sum up to a positive value and a halogen transfer compound whose oxidation potential is less than 0.85 V and whose reduction potential is less than −1.0 V with a developer containing a single developing agent of hydroquinone. U.S. Pat. No. 3,615,519 discloses a pre-fogged silver halide photographic material having added thereto an alkylene oxide polymer. U.S. Pat. No. 3,632,340 suggests a system in which a pre-fogged silver halide photographic material having an internal center accelerating the precipitation of photodecomposed silver is developed with a developer containing a single developing agent of hydroquinone. Further, JP-A-54-4118 (the term "JP-A" as used herein means an "unexamined published Japanese patent application"), JP-A-54-9620, JP-B-58-5420, JP-B-1-13090, and U.S. Pat. No. 4,273,862 teach a system in which a pre-fogged silver halide photographic material containing an anionic cyanine dye whose half wave oxidation potential is more positive than +0.4 V in polarography is developed with a lith developer.

However, although the contrast of these image formation systems is higher as compared with other methods, the contrast level is still insufficient for use in a photomechanical process.

SUMMARY OF THE INVENTION

An object of the present invention is to provide a novel direct positive silver halide photographic material which provides a high contrast positive image having a gamma exceeding 10.

Another object of the present invention is to provide a method for forming a high contrast positive image having a gamma exceeding 10 by using a stable developer.

The above objects of the present invention are accomplished by adding to a direct positive silver halide photographic material, a salt of a nitrogen-containing compound having at least one pyridine nucleus and at least one pyridinium nucleus.

The present invention relates to a direct positive silver halide photographic material having a pre-fogged direct positive silver halide emulsion layer, wherein said pre-fogged silver halide emulsion layer contains a salt of a nitrogen-containing compound having at least one pyridine nucleus and at least one pyridinium nucleus as a partial chemical structure.

The present invention also relates to a method for forming a high contrast positive image comprising imagewise exposing a direct positive silver halide photographic material having a pre-fogged silver halide emulsion layer, wherein said pre-fogged silver halide emulsion layer contains a salt of a nitrogen-containing compound having at least one pyridine nucleus and at least one pyridinium nucleus, and developing the exposed material with an alkaline developer containing a developing agent.

DETAILED DESCRIPTION OF THE INVENTION

The salt of a nitrogen-containing compound having at least one pyridine nucleus and at least one pyridinium nucleus as a partial chemical structure, which can be used in the present invention as an electron acceptor, includes (A) a salt of a nitrogen-containing compound in which a pyridine nucleus and a pyridinium nucleus are bonded to each other via a direct bond, (B) a salt of a nitrogen-containing compound in which a quinolinium nucleus or an isoquinolinium nucleus is bonded to a pyridine nucleus via a direct bond, (C) a salt of a nitrogen-containing compound in which a quinoline nucleus or an isoquinoline nucleus is bonded to a pyridinium nucleus via a direct bond, (D) a salt of a nitrogen-containing compound in which a quinolinium nucleus or an isoquinolinium nucleus is bonded to a quinoline nucleus or an isoquinoline nucleus via a direct bond, (E) a salt of a nitrogen-containing compound in which a pyridine nucleus and a pyridinium nucleus are fused together to form a condensed ring, and (F) a salt of a nitrogen-containing compound in which a pyridine nucleus and a pyridinium nucleus are fused to one benzene ring to form a condensed ring.

Examples of nitrogen-containing compound salts (A) to (D) include substituted or unsubstituted pyridinium pyridine compounds, substituted or unsubstituted quinolinium pyridine compounds, substituted or unsubstituted isoquinolinium pyridine compounds, substituted or unsubstituted pyridinium quinoline compounds, substituted or unsubstituted quinolinium quinoline compounds, substituted or unsubstituted isoquinolinium quinoline compounds, substituted or unsubstituted pyridinium isoquinoline compounds, substituted or unsubstituted quinolinium isoquinoline compounds, and substituted or unsubstituted isoquinolinium isoquinoline compounds.

Substituents which may be on the nitrogen atom of these compounds are selected from a substituted or unsubstituted alkyl group, a substituted or unsubstituted alkenyl group, a substituted or unsubstituted alkynyl group, a substituted or unsubstituted aryl group, and a substituted or unsubstituted heterocyclic group. Specific examples of these substituents are methyl, ethyl, n-propyl, isopropyl, n-butyl, isobutyl, pentyl, ethenyl, propenyl, butenyl, acetylenyl, propargyl, 2-hydroxyethyl, 3-hydroxypropyl, 2-methoxyethyl, 3-ethoxypropyl, 2-phenylethyl, 3-acetylpropyl, 2-benzoylethyl, 2-methoxycarbonylethyl, 2-cyanoethyl, 2-carbamoylethyl, pyridyl, quinolinyl, isoquinolinyl, diazaphenanthrenyl, phenanthrolinyl, and acridinyl groups.

Substituents which may be on an atom or atoms other than the nitrogen atom of these compounds include a hydrogen atom, a halogen atom, a substituted or unsubstituted alkyl group (e.g., methyl, ethyl, n-propyl, isopropyl, n-butyl, isobutyl or pentyl group), a substituted or unsubstituted alkenyl group (e.g., ethenyl), propenyl or butenyl group), and a substituted or unsubstituted alkynyl group (e.g., acetylenyl, propargyl or butynyl group). Substituents which may be on the alkyl, alkenyl or alkynyl group preferably include a hydroxyl group, a halogen atom, a lower alkoxy group, and a substituted or unsubstituted aromatic group (e.g., a phenyl group or an alkyl-substituted phenyl group). Specific examples of the substituted alkyl, alkenyl or alkynyl groups are hydroxymethyl, 2-hydroxyethyl, 3-hydroxypropyl, 3-hydroxy-2-propenyl, chloromethyl, chloroethyl, chloropropyl, chloropropylenyl, chlorobutyl, chlorobutenyl, chlorobutynyl, 2-methoxyethyl, 2-ethoxyethyl, benzyl, 2-phenylethyl, and 2-tolylethyl groups.

Substituents which may be on an atom or atoms other than the nitrogen atom of these compounds further include a substituted or unsubstituted alkoxy group (e.g., methoxy, ethoxy, propoxy or butoxy group). Substituents on the alkoxy group preferably include a halogen atom, a lower alkoxy group, and a substituted or unsubstituted aromatic group (e.g., phenyl or alkyl-substituted phenyl group). Specific examples of the substituted alkoxy group are monochloromethoxy, 4-chlorobutoxy, 2-methoxyethoxy, benzyloxy and 2-tolylethoxy groups.

Furthermore included in the substituents which may be on an atom or atoms other the nitrogen atom are a substituted or unsubstituted alkoxycarbonyl group (e.g., methoxycarbonyl, ethoxycarbonyl, propoxycarbonyl, butoxycarbonyl, 2-chloroethyloxycarbonyl, 2-ethoxyethoxycarbonyl or benzyloxycarbonyl group), a substituted or unsubstituted carbamoyl group (e.g., amide, N-methylamide, N-ethylamide, N-isopropylamide, N-butylamide, N-benzylamide, N-tolylamide, N,N'-dimethylamide, N-ethyl-N'-methylamide, N,N'-dipropylamide or N,N'-dibutylamide group), a substituted or unsubstituted amino group (e.g., amino, N-methylamino, N-ethylamino, N-propylamino, N-butylamino, N-cyclohexylamino, N-benzylamino, N-acetylamino, N,N'-dimethylamino, N,N'-diethylamino, N,N'-dipropylamino, N-methyl-N'-ethylamino, or N-methyl-N'-cyclohexylamino group), a carboxyl group, a sulfo group, a sulfonamide group, a sulfonic ester group, a phospho group, and a phosphoric ester group.

These substituents may be taken together to form a ring, e.g., a 5-, 6- or 7-membered ring, which may be between a pyridine nucleus and a pyridinium nucleus.

Specific examples of nitrogen-containing compound salts (A) to (D) include 4-(1'-pyridinium)pyridine compounds, 4(1'-pyridinium)quinoline compounds, 4-(1'-quinolinium)pyridine compounds, 4-(1'-quinolinium)-quinoline compounds, 1-substituted-2-(4'-pyridyl)-pyridinium compounds, 1-substituted-3-(4'-pyridyl)-pyridinium compounds, 1-substituted-4-(4'-pyridyl)-pyridinium compounds, 1-substituted-2-(4'-pyridyl)-quinolinium compounds, 1-substituted-3-(4'-pyridyl)-quinolinium compounds, 1-substituted-4-(4'-pyridyl)-quinolinium compounds, 1-substituted-2-(4'-quinolino)-pyridinium compounds, 1-substituted-3-(4'-quinolino)-pyridinium compounds, 1-substituted-4-(4'-quinolino)-pyridinium compounds, 1-substituted-2-(4'-quinolino)-quinolinium compounds, 1-substituted-3-(4'-quinolino)-quinolinium compounds, 1-substituted-4-(4'-quinolino)-quinolinium compounds, 5-(1'-pyridinium)quinoline compounds, 6-(1'-pyridinium)quinoline compounds, 5-(1'-quinolinium)quinoline compounds, 6-(1'-quinolinium)quinoline compounds, 1-substituted-2-(5'-quinolino)pyridinium compounds, 1-substituted-2-(6'-quinolino)pyridinium compounds, 1-substituted-3-(5'-quinolino)pyridinium compounds, 1-substituted-3-(6'-quinolino)pyridinium compounds, 1-substituted-4-(5'-quinolino)pyridinium compounds, 1-substituted-4-(6'-quinolino)pyridinium compounds, 1-substituted-5-(4'-pyridino)quinolinium compounds, and 1-substituted-6-(4'-pyridino)quinolinium compounds. Substituents in these compounds include methyl, ethyl, n-propyl, isopropyl, n-butyl, isobutyl, pentyl, ethenyl, propenyl, butenyl, acetylenyl, propargyl, 2-hydroxyethyl, 3-hydroxypropyl, 2-methoxyethyl, 3-ethoxypropyl, 2-phenylethyl, 3-acetylpropyl, 2-benzoylethyl, 2-methoxycarbonylethyl, 2-cyanoethyl, 2-carbamoylethyl, pyridyl, quinolinyl, isoquinolyl, diazaphenanthrenyl, phenanthrolinyl, and acridinyl groups.

These salt compounds are salts with an anion, such as an iodide ion, a bromide ion, a chloride ion, a p-toluenesulfonate ion, a perchlorate ion, a methylsulfate ion, a nitrate ion, a phosphate ion, a sulfate ion, a carbonate ion, an organic carboxylate ion, and an organic sulfonate ion.

Nitrogen-containing compound salts (E) and (F) include salts of mono-N-substituted diazaphenanthrene compounds. Examples of the mono-N-substituted diazaphenanthrene compounds include mono-N-substituted-1,7-diazaphenanthrene (or m-phenanthroline) compounds, mono-N-substituted-1,8-diazaphenanthrene compounds, mono-N-substituted-1,10-diazaphenanthrene (or o-phenanthroline) compounds, mono-N-substituted-3,8-diazaphenanthrene compounds or mono-N-substituted-4,7-diazaphenanthrene (or p-phenanthroline) compounds, mono-N-substituted-1,6-diazaphenanthrene compounds, mono-N-substituted-3,5-diazaphenanthrene compounds, mono-N-substituted-3,6-diazaphenanthrene compounds, and mono-N-substituted-4,5-diazaphenanthrene compounds. Substituents in these compounds include methyl, ethyl, n-propyl, isopropyl, n-butyl, isobutyl, pentyl, ethenyl, propenyl, butenyl, acetylenyl, propargyl, 2-hydroxyethyl, 3-hydroxypropyl, 2-methoxyethyl, 3-ethoxypropyl, 2-phenylethyl, 3-acetylpropyl, 2-benzoylethyl, 2-methoxycarbonylethyl, 2-cyanoethyl, 2-carbamoylethyl, pyridyl, quinolinyl, isoquinolyl, diazaphenanthrenyl, phenanthrolinyl, and acridinyl groups.

These salt compounds are salts with an anion, such as an iodide ion, a bromide ion, a chloride ion, a p-toluenesulfonate ion, a perchlorate ion, a methylsulfate ion, a nitrate ion, a phosphate ion, a sulfate ion, a carbonate ion, an organic carboxylate ion, and an organic sulfonate ion.

The above-described nitrogen-containing compound salts are represented by formulae (II) to (V) shown below.

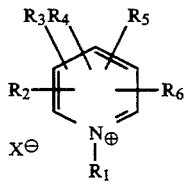

(II)

wherein $R_1$ represents a substituted or unsubstituted alkyl group, an alkenyl group, an alkynyl group or a heterocyclic group containing at least one pyridine nucleus; and $R_2$, $R_3$, $R_4$, $R_5$ and $R_6$ each represent a hydrogen atom, a halogen atom, a substituted or unsubstituted alkyl group, a substituted or unsubstituted alkenyl group, a substituted or unsubstituted alkynyl group, a substituted or unsubstituted aryl group, a hydroxyl group, an alkoxy group, an amino group, an N-substituted amino group, an N,N-disubstituted amino group, a carbamoyl group, an N-substituted carbamoyl group, a carboalkoxy group, a formyl group, a carboxyl group, a sulfo group, a sulfonamide group, a sulfonic ester group, a phospho group, a phosphoric ester group or a substituted or unsubstituted heterocyclic ring; at least one of $R_1$, $R_2$, $R_3$, $R_4$, $R_5$ and $R_6$ is a substituent containing a pyridine nucleus; any two of $R_1$, $R_2$, $R_3$, $R_4$, $R_5$ and $R_6$ may be taken together to form a substituted or unsubstituted ring; and $X^-$ represents an anion.

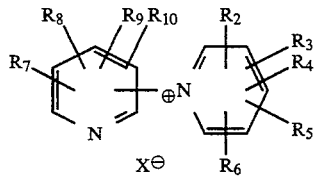

(III)

wherein $R_2$, $R_3$, $R_4$, $R_5$, $R_6$, and $X^-$ are as defined in formula (II); $R_7$, $R_8$, $R_9$, and $R_{10}$ each represent a hydrogen atom, a halogen atom, a substituted or unsubstituted alkyl group, a substituted or unsubstituted alkenyl group, a substituted or unsubstituted alkynyl group, a substituted or unsubstituted aryl group, a hydroxyl group, an alkoxy group, an amino group, an N-substituted amino group, an N,N-disubstituted amino group, a carbamoyl group, an N-substituted carbamoyl group, a carboalkoxy group, a formyl group, a carboxyl group, a sulfo group, a sulfonamide group, a sulfonic ester group, a phospho group or a phosphoric ester group; any two of $R_2$, $R_3$, $R_4$, $R_5$, $R_6$, $R_7$, $R_8$, $R_9$, and $R_{10}$ may be taken together to form a substituted or unsubstituted ring.

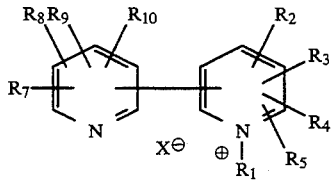

(IV)

wherein $R_1$, $R_2$, $R_3$, $R_4$, $R_5$, and $X^-$ are as defined in formula (II); and $R_7$, $R_8$, $R_9$, and $R_{10}$ are as defined in formula (III); any two of $R_1$, $R_2$, $R_3$, $R_4$, $R_5$, $R_6$, $R_7$, $R_8$, $R_9$, and $R_{10}$ may be taken together to form a substituted or unsubstituted ring.

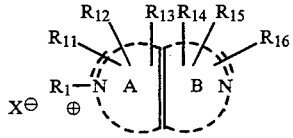

(V)

wherein $R_1$ and $X^-$ are as defined in formula (II); ring A represents a pyridinium nucleus; ring B represents a pyridine nucleus; rings A and B form a condensed ring; and $R_{11}$, $R_{12}$, $R_{13}$, $R_{14}$, $R_{15}$ and $R_{16}$ each represent a hydrogen atom, a halogen atom, a substituted or unsubstituted alkyl group, a substituted or unsubstituted alkenyl group, a substituted or unsubstituted alkynyl group, a substituted or unsubstituted aryl group, a hyroxyl group, an alkoxy group, an amino group, an N-substituted amino group, an N,N-disubstituted amino group, a carbamoyl group, an N-substituted carbamoyl group, a carboalkoxy group, a formyl group, a carboxyl group, a sulfo group, a sulfonamide group, a sulfonic ester group, a phospho group or a phosphoric ester group; any two of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, and $R_{16}$, may be taken together to form a substituted or unsubstituted ring.

Specific examples of suitable nitrogen-containing compound salts having at least one pyridine nucleus and at least one pyridinium nucleus as a partial structure are shown below (Compound Nos. 1 to 68) for illustrative purposes only but not for limitation.

1
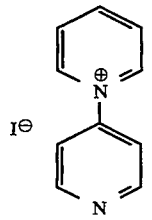
2
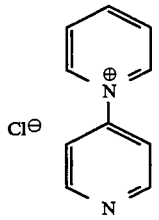
3
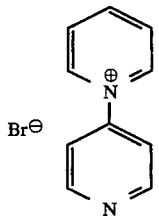
4
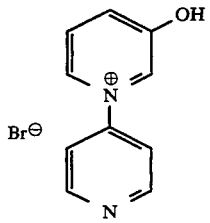
5
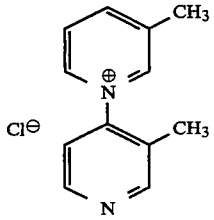
6
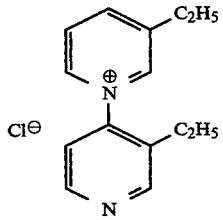
7
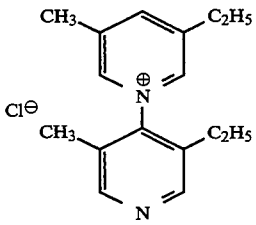
-continued
8
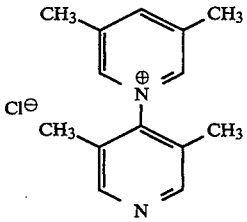
9
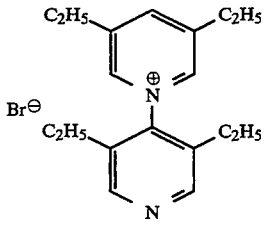
10
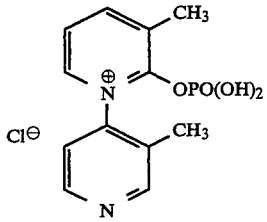
11
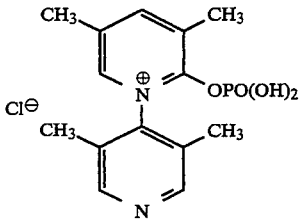
12
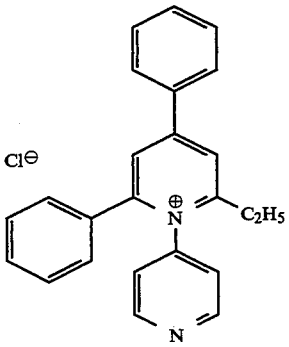
13
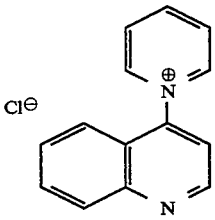

-continued
14
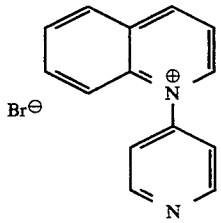
15
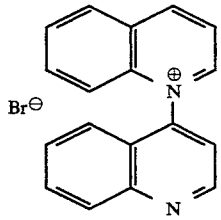
16
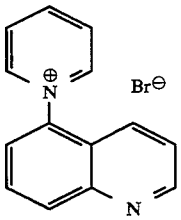
17
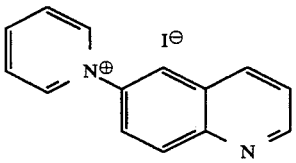
18
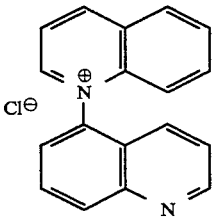
19
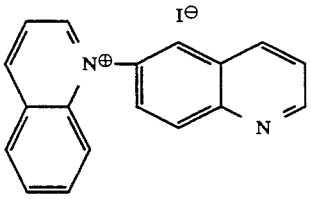
20
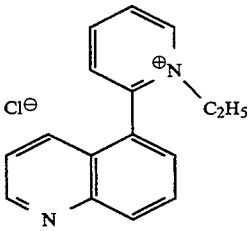
-continued
21
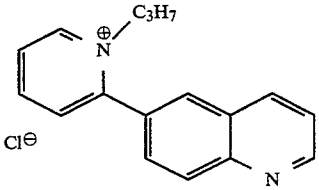
22
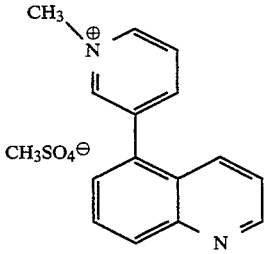
23
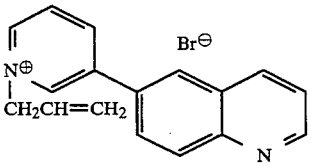
24
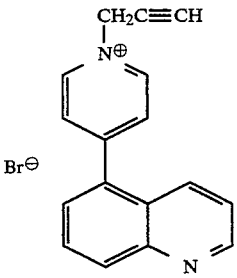
25
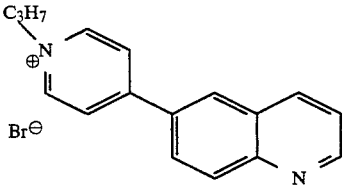
26
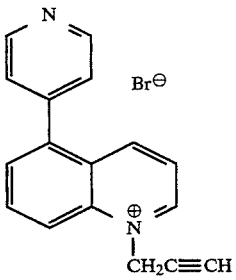
27
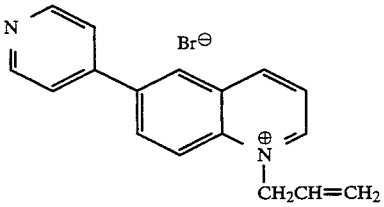

-continued
28
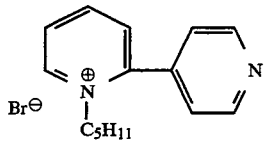
29
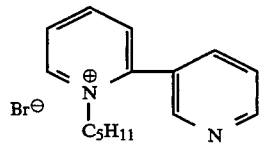
30
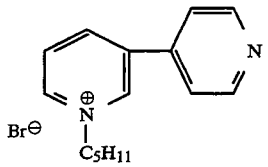
31
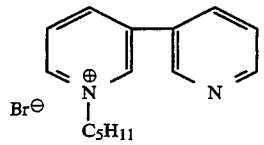
32
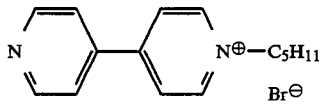
33
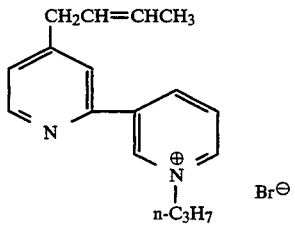
34
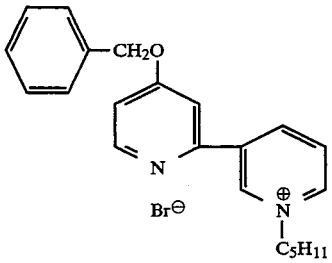
35
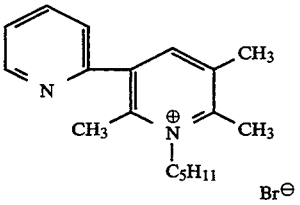
-continued
36
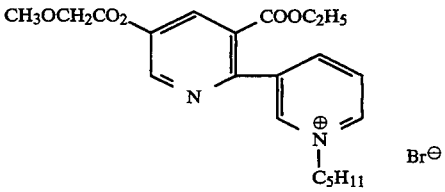
37
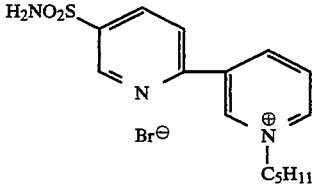
38
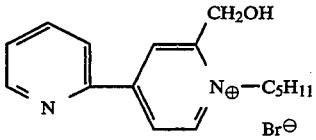
39
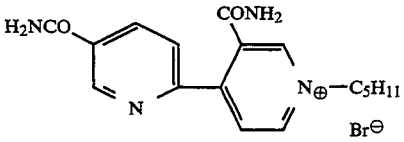
40
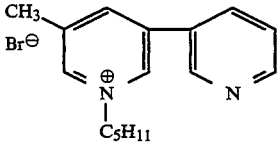
41
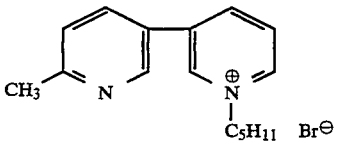
42
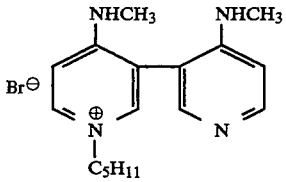
43
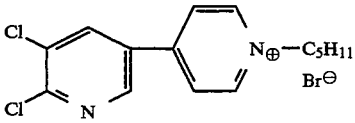
44
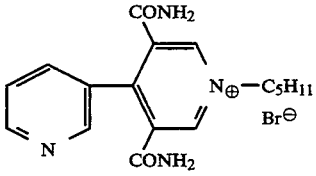

-continued
45
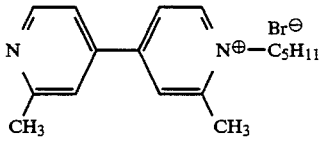
46
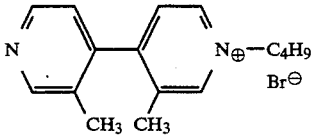
47
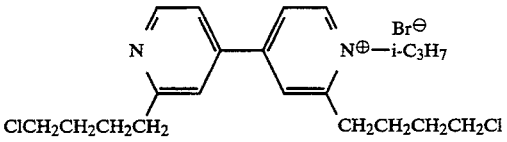
48
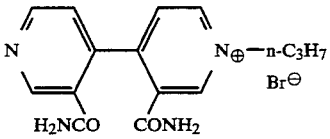
49
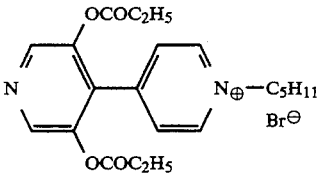
50
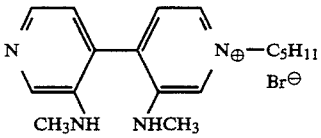
51
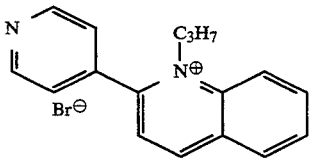
52
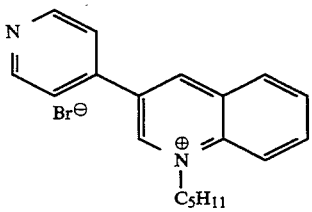
53
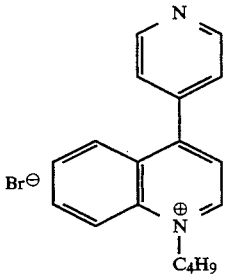
-continued
54
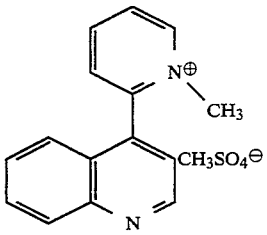
55
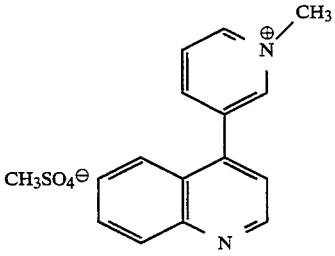
56
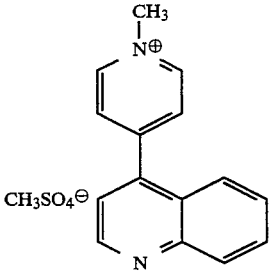
57
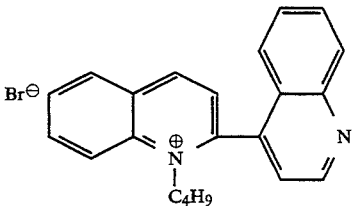
58
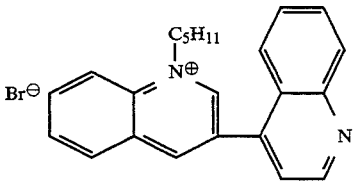
59
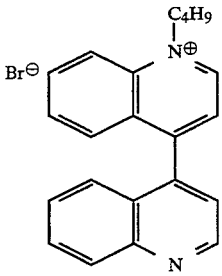

-continued

60

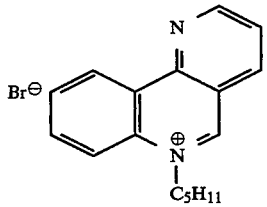

61

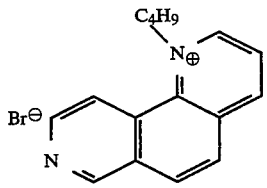

62

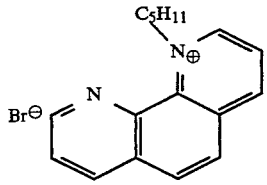

63

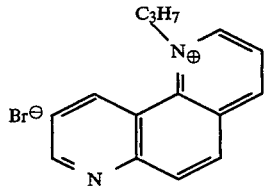

64

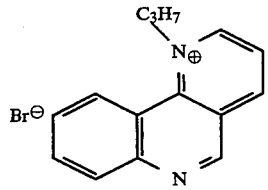

65

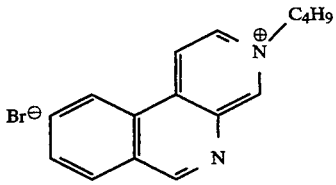

66

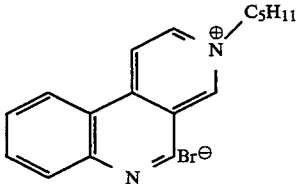

67

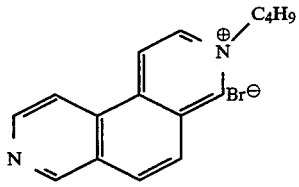

-continued

68

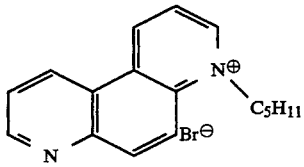

The nitrogen-containing compound salts which can be used in the present invention can easily be prepared by, for example, reacting a compound having two or more pyridine nuclei per molecule, which may be commercially available or synthesized through processes known by literature, with an equimolar amount of a substituted or unsubstituted halogen compound according to the process of Khaskin, B.A., et al., *Zh. Obshch. Khim.*, Vol. 42, p. 2061 (1972) or the process of *Chemical Abstract*, Vol. 78, 29562f (1973).

The nitrogen-containing compounds which can be used in the present invention are known compounds and can be synthesized in accordance with known processes described, e.g., in JP-B-62-10506, JP-A-55-5916, JP-A-57-72961, JP-A-57-102864, JP-A-57-108068, JP-A-57-108069; German Patent 613402, German Patent (OLS) No. 3,241,429, Czech Patent 110,949, *Ber.*, Vol. 64, p. 1049 (1931), *J. Chem. Soc., Perkin Trans.* 1, No. 2, p. 399 (1979), *Synthesis*, No. 6, p. 454 (1979), *Rev. Roum. Chim.*, No. 25, p. 1505 (1980), *Yiyao Gongye*, No. 10, p. 21 (1983), M. Hamana, et al, *YAKUGAKU ZASSHI*, Vol. 82, p. 512 (1962), ibid, Vol. 84, p. 28 (1964), and ibid, Vol. 86, p. 59 (1966).

The diazaphenanthrene compounds according to the present invention can be synthesized by the processes disclosed, e.g., J.R. Thirtle, *The Chemistry of Heterocyclic Compounds*, Vol. 20, p. 320, Interscience Publishers, Inc., New York (1958), and B. Graham, ibid, p. 386.

In order to obtain high contrast positive images, the existence of the nitrogen-containing compound salt having at least one pyridine nucleus and at least one pyridinium nucleus per molecule is essential. Other pyridine or pyridinium compounds, for example, N,N'-disubstituted bipyridinium compounds in which two nitrogen atoms are both substituted fail to produce the effects as desired.

While the nitrogen-containing compound salt of the present invention acts as an electron acceptor, it is clearly distinguished from known bipyridinium compounds for its effect on an increase in contrast. The mechanism of action in increasing contrast has not yet been elucidated, it is assumed that the nitrogen-containing compound salt of the present invention functions as an electron accepting compound on exposure and as a nucleating compound on development. Hence, the silver halide photographic material of the present invention and the image formation method using the same are based on a novel mode of action not heretofore reported.

The nitrogen-containing compound salt of the present invention may be incorporated into a silver halide photographic emulsion either directly or via a solution in water or a water-soluble solvent (e.g., methanol, ethanol or methyl cellosolve) or a mixture thereof at any stage during preparation of the emulsion. It is preferably added to an emulsion after a fogging treatment and before coating. The amount of the compound to be added usually ranges from $5\times10^{-4}$ to $5\times10^{-1}$ mol, and preferably from $5\times10^{-3}$ to $2\times10^{-2}$ mol, per mol of silver halide, while varying depending on various factors, such as the kind of the compound, the kind of silver halides, the pH of pAg of the emulsion, the amounts of kinds of other additives, and so forth.

Silver halides which can be used in the silver halide photographic emulsion include silver chloride, silver chlorobromide, silver chloroiodobromide, silver bromide, silver iodobromide, etc. The silver halide photographic emulsions are prepared through various known processes, including a process of incorporating a soluble salt of a metal belonging to the group VIII (see U.S. Pat. No. 1,186,717), a process for preparing an ammoniacal emulsion (see U.S. Pat. No. 2,184,013), a process for preparing a mono-dispersed emulsion (see U.S. Pat. No. 3,501,305), a process for preparing a hetero-dispersed emulsion (see JP-A-49-43627), a process for preparing an emulsion of regular silver halide grains (see U.S. Pat. No. 3,501,306), and a process for preparing covered silver halide grains (see U.S. Pat. No. 3,367,785 and British Patents 1,229,865 and 1,186,718).

In the present invention, the prepared silver halide emulsion is previously fogged by an appropriate treatment. For example, an emulsion is uniformly exposed to light (light fog) or treated with an appropriate reducing agent or a metallic compound which is electrically more positive than silver as disclosed in British Patent 723,019 (chemical fog). It is effective for obtaining a direct positive emulsion of high sensitivity of fog an emulsion by combination of a reducing agent and a gold compound as suggested in JP-A-46-40900. It is more effective for obtaining a higher contrast and more sensitive positive to fog an emulsion by combination of a metallic compound which is electrically more positive than silver and at least one compound selected from a thiosulfate, a thiocyanate and a prussiate, which may be further combined with a reducing agent, as taught in JP-B-49-11563 and JP-A-49-22118.

Suitable reducing agents as chemical fogging agents include formalin, hydrazine, polyamines (e.g., triethylenetetramine or tetraethylenepentamine), formamidinesulfinic acid, tetra(hydroxymethyl)phosphonium chloride, aminoborates, borohydride compounds, stannous chloride, and stannic chloride. Typical metallic compounds which are electrically more positive than silver include soluble salts of gold, rhodium, platinum, palladium, iridium, etc., such as potassium chloroaurate, chloroauric acid, ammonium palladium chloride, and sodium iridium chloride.

The degree of fogging of the emulsion is subject to wide variation in relation to the silver halide composition of the emulsion, the size of silver halide grains, the kind of the fogging agent used, a desired density, the pH, pAg or temperature of the emulsion, the time of fogging, and the like. For the details, reference can be made to U.S. Pat. Nos. 3,023,102, 3,367,778, 3,361,564, 3,501,305, 3,501,306, 3,501,307, and 3,637,392, and British Patent 707,704.

If desired, the nitrogen-containing compound salt of the present invention, while functioning as an electron acceptor by itself, may be used in combination with other known electron acceptors. For example, a polyvalent cation may be incorporated into the inside of silver halide crystals as an inorganic desensitizing dopant, or an organic desensitizer exemplified in the above-enumerated literature may be used. Suitable inorganic desensitizers include soluble rhodium salts and soluble iridium salts. Incorporation of the inorganic desensitizers into the inside of silver halide crystals can be effected by adding the compound of the system for preparing silver halide crystals. The inorganic desensitizer is suitably added in an amount of from $1\times10^{-8}$ to $1\times10^{-2}$ mol per mole of silver halide.

If desired, the direct positive silver halide emulsion may contain known sensitizing dyes, such as cyanine dyes and rhodanine dyes, in addition to the electron acceptor.

The emulsion may further contain other photographically useful additives. Photographically useful additives which are usually added to the emulsion include stabilizers, such as the compounds described in JP-B-49-16053, JP-B-49-12651 and JP-A-48-66828, triazole compounds, azaindene compounds, benzothiazolium compounds, mercapto compounds, and water-soluble inorganic salts of cadmium, cobalt, nickel, manganese, zinc, etc., hardening agents, such as aldehydes (e.g., formalin, glyoxal and mucochloric acid), s-triazine compounds, epoxy compounds, aziridines, and vinylsulfonic acids; coating aids, such as saponin, sodium polyalkylenesufonates, polyethylene glycol lauryl or oleyl monoether, acylated N-acyltaurine, and fluorine-containing compounds described in JP-A-49-10722 and JP-A-49-46733; development accelerators, such as polyalklene oxides and derivatives thereof as described in JP-B-42-25203, JP-B-43-10245, JP-B-43-13822, JP-B-43-17926, JP-B-46-21186, JP-B-49-8102, and JP-B-49-8332; ultraviolet absorbents, preservatives, matting agents, antistatic agents, and the like.

Protective colloid to be used in the direct positive silver halide emulsion includes naturally occurring substances, such as gelatin, gelatin derivatives, albumin, agar, gum arabic, and alginic acid, and hydrophilic polymers, such as polyvinyl ether, polyvinyl acrylate, polyvinylpyrrolidone, cellulose esters, partial hydrolysis product of cellulose actate, and ethylene oxide-grafted poly(N-hydroxyalkyl)-$\beta$-alanine derivatives described in JP-B-49-20530.

The silver halide emulsion may also contain, as a binder, a dispersion polymer of a vinyl compound, such as a polymer latex obtained by emulsion polymerization of an ethylenically unsaturated monomer in the presence of an activator (see JP-B-49-32344) or a polymer latex obtained by graft polymerization of a hydroxyl-containing high-molecular compound and an ethylenically unsaturated monomer in the presence of a cerium (II) salt (see JP-B-49-20964). Incorporation of these polymer latices is effective to improve film properties.

In addition, the emulsion may contain a protected developer as taught in JP-B-44-2523 or JP-B-44-9499; protected liquid paraffin or protected glycerol stearate acetate for improving film properties; or protected stabilizers or ultraviolet absorbents according to the purpose.

The thus prepared direct positive silver halide photographic emulsion is coated on an appropriate photographic support, such as glass, wood, metal, plastic films (e.g., cellulose acetate, cellulose nitrate, polyester, polyamide or polystyrene), paper, baryta paper, polyolefin-coated paper, etc.

The developer for developing an imagewise exposed direct positive silver halide photographic material to provide a high contrast image will hereinafter be described.

Developing agents to be used in the developer include reductone compounds (e.g., ascorbic acid and isoascorbic acid), dihydroxybenzene compounds (e.g., hydroquinone, chlorohydroquinone, 2,3-dichlorohydroquinone, catechol, and pyrazole), 3-pyrazolidone compounds (e.g., 1-phenyl-3-pyrazolidone, 1-phenyl-4,4-dimethyl-3-pyrazolidone, and 1-phenyl-4,4-dihydroxymethyl-3-pyrazolidone), 3-aminopyrazoline compounds (e.g., 1-(p-hydroxyphenyl)-3-aminopyrazoline and 1-(p-methylaminophenyl)-3-aminopyrazoline), phenylenedeiamine compounds (e.g., 4-amino-N,N-diethylaniline, 4-amino-N-ethyl-N-β-hydroxyethylaniline, and 3-methyl-4-amino-N-ethyl-N-β-hydroxyethylaniline), aminophenols (e.g., 4-aminophenol, 4-(N-methyl-)aminophenol, N-(4-hydroxyphenyl)glycine, and 2-hydroxymethyl-4-(N-methyl)aminophenol), and hydrochlorides and sulfates of these compounds. Particularly preferred of them are reductone compounds and dihydroxybenzene compounds.

Generally known reductone compounds include endiol compounds, enaminol compounds, endiamine compounds, thiol-enol compounds, and enamine-thiol compounds. Specific examples of these reductone compounds are mentioned, e.g., in U.S. Pat. Nos. 2,688,549, 2,691,589 and 3,347,671, JP-A-62-237443, and C. A. Buehler, *Chem. Rev.*, Vol. 64, p. 7 (1964). Any of the known reductone compounds may be used as a developing agent in the present invention. Processes for synthesizing the reductone compounds are also well known. For example, Danji Nomura & Hirohisa Ohmura, *REDUCTONE NO KAGAKU*, Uchida Rokakuho Shinsha (1969) can be referred to for the details.

Of the known reductone compounds, preferred are those represented by formula (I):

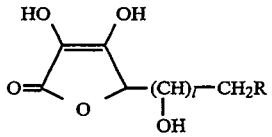

(I)

wherein R represents a hydrogen atom or a hydroxyl group; and l represents an integer of from 0 to 3.

Specific examples of reductone compounds represented by formula (I) are shown below (R-1 to R-12) for illustrative purposes only but not form limitation.

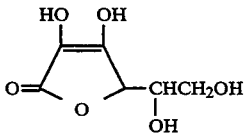

R-1

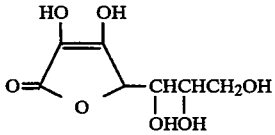

R-2

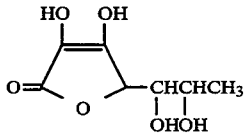

R-3

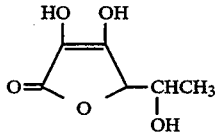

R-4

-continued

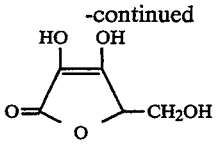

R-5

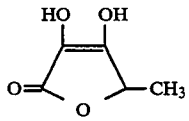

R-6

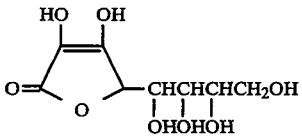

R-7

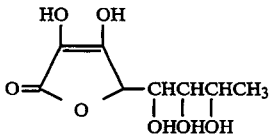

R-8

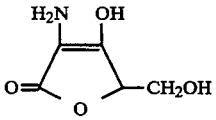

R-9

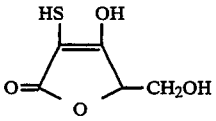

R-10

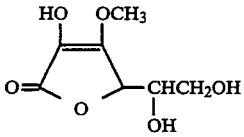

R-11

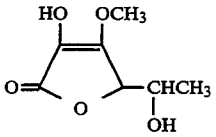

R-12

The reductone compound may be used in the form of an alkali metal salt thereof, e.g., a lithium salt, a sodium salt or potassium salt. The reductone compound is used in an amount usually of from 1 g to 100 g, and preferably of from 5 g to 50 g, per liter of a developer. The dihydroxybenzene compound is used in an amount of from 10 g to 150 g, and preferably of from 20 g to 70 g, per liter of a developer.

In addition to the above-mentioned reductone compound developing agent, the developer may contain auxiliary developing agents. Examples of suitable auxiliary developing agents are dihydroxybenzene compounds (e.g., hydroquinone, chlorohydroquinone, bromohydroquinone, isopropylhydroquinone, methylhydroquinone, 2,3-dichlorohydroquinone, 2,3-dibromohydroquinone, 2,5-dimethylhydroquinone, potassium hydroquinone monosulfonate, sodium hydroquinone monosulfonate, catechol, and pyrazole), 3-pyrazolidone compounds (e.g., 1-phenyl-3-pyrazolidone, 1-phenyl-4-methyl-3-pyrazolidone, 1-phenyl-5-methyl-3-pyrazolidone, 1-phenyl-4-ethyl-3-pyrazoline, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1,5-diphenyl-3-pyrazolidone, 1-p-tolyl-3-pyrazolidone), 1-phenyl-2-acetyl-4,4-dimethyl-3-pyrazolidone, 1-1-p-hydroxyphenyl-4,4-dimethyl-3-pyrazolidone, 1-(2-benzothiazolyl)-3-pyrazolidone, and 3-acetoxy-1-phenyl-3-pyrazolidone), 3-aminopyrazoline compounds (e.g., 1-(p-hydroxyphenyl)-3-aminopyrazoline, 1-(p-methylaminophenyl)-3-aminopyrazoline, and 1(p-amino-m-methylphenyl)-3-aminopyrazoline), phenylenediamine compounds (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, and 3-methyl-4-amino-N-ethyl-N-$\beta$methoxyethylaniline), aminophenols (e.g., 4-aminophenol, 4-amino-3-methylphenol, 4-(N-methyl)aminophenol, 2,4-diaminophenol, N-(4-hydroxyphenyl)glycine, N-(2'-hydroxyethyl)-2aminophenol, 2-hydroxymethyl-4-aminophenol, and 2-hydroxymethyl-4-(N-methyl)aminophenol), and hydrochlorides and sulfates of these compounds.

These auxiliary developing agents are used in an amount usually of from 0.2 to 20 g, and preferably of from 0.5 to 5 g, per liter of a developer.

According to the image formation method of the present invention, the silver halide photographic material containing the nitrogen-containing compound salt of the present invention is imagewise exposed to light and developed with a developer containing the above-mentioned reductone compound as a developing agent and, if desired, an auxiliary developing agent, such as a dihydroxybenzene compound, a 3-pyrazolidone compound, a 3-aminopyrazoline compound, a p-phenylenediamine compound or an aminophenol. A particularly preferred developer is an alkaline developer containing a reductone compound represented by formula (I) and a p-aminophenol as an auxiliary developing agent.

In addition to the reductone compound and, if desired, the auxiliary developing agent, the developer preferably contains a preservative and an alkali. Sulfites, such as sodium sulfite, potassium sulfite, lithium sulfite, ammonium sulfite, sodium bisulfite, potassium bisulfite, and potassium metabisulfite, are suitable preservatives. The sulfite preservative is preferably added in an amount of not more than 0.5 mol per liter of a developer.

The alkali is added to adjust the pH of a developer at 9 or higher. Alkalis for pH adjustment include general water-soluble inorganic alkali metal salts, such as lithium hydroxide, sodium hydroxide, potassium hydroxide, sodium carbonate, sodium hydrogencarbonate, potassium carbonate, potassium hydrogencarbonate, and potassium tertiary phosphate.

If desired, the developer may further contain other additives as far as the effects of the present invention are not impaired. Useful additives include a water-soluble acid (e.g., acetic acid or boric acid), a pH buffer (e.g., sodium tertiary phosphate, sodium carbonate, potassium carbonate, sodium metaborate or lithium tetraborate), an inorganic antifoggant (e.g., sodium bromide or potassium bromide), an organic antifoggant (e.g., 1-phenyl-5-mercaptotetrazole or 5-nitroindazole), an organic solvent (e.g., ethylene glycol, diethylene glycol or methyl cellosolve), a toning agent, a surface active agent, a defoaming agent, a hard water softener, a development accelerator, and so on.

The developer is carried out at a developer temperature of from 18° to 18° C., and preferably from 20° to 40° C.

For fixing, conventional fixer compositions can be used in the present invention. Examples of suitable fixer compositions are described, e.g., in Nihon Shashin Gakkai ed.), *SHASHIN KOGAKU NO KISO, GIN-EN SHASHIN HEN*,infra p. 330, Corona Publishing Co., Ltd. (1979), Akira Sasai, *SHASHIN NO KAGAKU*, infra p. 320, Shashin Kogyo Shuppansha (1982), and W. Thomas, Jr. (ed), *SPSE HANDBOOK OF PHOTOGRAPHIC SCIENCE AND ENGINEERING*, p. 528, John Wiley & Sons (1973).Fixing agents to be used in a fixer include thiosulfates, thiocyanates and organic sulfur compounds known to have a fixing effect. Fixing aids to be used in a fixer include acid agents (e.g., acetic acid and citric acid), preservatives (e.g., sodium sulfite), buffers (e.g., boric acid), and hardening agents (e.g., potassium alum, alum and aluminum sulfate). Fixing is preferably carried out at a temperature of from 20° to 50° C. for a period of from 10 seconds to 5 minutes.

The present invention will now be illustrated in greater detail with reference to Examples, but the present invention should not be construed as being limited thereto.

EXAMPLE 1

A silver nitrate aqueous solution and a potassium bromide aqueous solution containing $3.0\times10^{-7}$ mol, per mol of silver, of sodium hexabromorhodate (III) were added simultaneously to a gelatin aqueous solution kept at 60° C. while maintaining the pAg at 7.0 over 60 minutes to prepare a mono-dispersed emulsion comprising cubic silver bromide grains having an average particle size of 0.20 $\mu$m. Soluble salts were removed in a usual manner, and $12\times10^{-3}$ mol, per mol of silver halide, of 6-hydroxy-4-methyl-1,3,3*a*,7-tetraazaindene was added. The resulting emulsion was coated on a polyethylene terephthalate (PET) support to a silver coverage of 40 mg per $dm^2$. A gelatin protective layer containing formalin and dimethylolurea as hardening agents was coated thereon.

The resulting film was fogged by daylight fluorescent lighting. Then, a 0.02M or 0.05M solution of the compound shown in Table 1 below in a mixed solvent of water and ethanol was coated on the film and dried to prepare a sample film (hereinafter designated Samples 101 to 110).

Each sample was exposed through a step wedge having density differences of 0.15 to light emitted from a tungsten lamp (color temperature: 2666 K) and adjusted by an LB 200 filter for 100 seconds, developed with Developer 1 having the following formulation at 20° C. for 5 minutes, stopped, fixed, washed with water, and dried. The photographic characteristics of the resulting image are shown in Table 2 below. In Table 2, $D_{min}$ is a minimum density in the exposed area, $D_{max}$ is a maximum density in the unexposed area, and gamma ($\gamma$) is an average gradient between A point ($D_{min}+0.5$) and B point ($D_{min}+3.0$) (hereinafter the same).

Formulation of Developer 1:

| | |
|---|---|
| Methol | 2.5 g |
| Sodium ascorbate (sodium salt of R-1) | 10.0 g |
| Potassium bromide | 1.0 g |
| Sodium metaborate tetrahydrate | 35.0 g |
| Water to make | 1.0 l |

-continued

| | |
|---|---|
| pH | 10.8 |

TABLE 1

| Sample No. | Compound Added | Amount Added (mmol/mol Ag) | Remark |
|---|---|---|---|
| 101 | none | — | comparison |
| 102 | Comparative Compound (1) | 10 | " |
| 103 | Comparative Compound (2) | 10 | " |
| 104 | hydrochloride of Compound 2 | 10 | invention |
| 105 | hydrochloride of Compound 5 | 10 | " |
| 106 | hydrochloride of Compound 13 | 10 | " |
| 107 | hydrochloride of Compound 28 | 10 | " |
| 108 | hydrochloride of Compound 32 | 10 | " |
| 109 | hydrochloride of Compound 48 | 10 | " |
| 110 | hydrochloride of Compound 64 | 10 | " |

Comparative Compound (1):

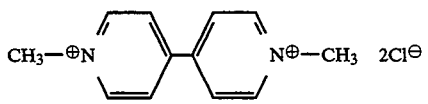

Comparative Compound (2):

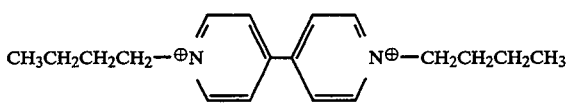

TABLE 2

| Sample No. | Gamma | $D_{min}$ | $D_{max}$ |
|---|---|---|---|
| 101 | no positive image was formed. | | |
| 102 | 6.1 | 0.06 | ≧4 |
| 103 | 5.6 | 0.08 | ≧4 |
| 104 | 17.5 | 0.07 | ≧4 |
| 105 | 13.2 | 0.08 | ≧4 |
| 106 | 12.7 | 0.06 | ≧4 |
| 107 | 13.3 | 0.04 | ≧4 |
| 108 | 17.5 | 0.05 | ≧4 |
| 109 | 13.2 | 0.04 | ≧4 |
| 110 | 11.6 | 0.06 | ≧4 |

As can be seen from Table 2, Samples 104 to 110 containing the nitrogen-containing compound salt according to the present invention exhibited high contact characteristics having a gamma exceeding 10, while Sample 101 containing no electron acceptor failed to form a positive image and Samples 102 to 103 containing a comparative electron acceptor provided a positive image but attained a low contrast.

EXAMPLE 2

A silver nitrate aqueous solution and a mixed aqueous solution of potassium bromide and sodium chloride (Br:Cl molar ratio: 30:70) containing $1.5\times10^{-7}$ mol, per mol of silver, of sodium hexachlororhodate (III) were added simultaneously to a gelatin aqueous solution kept at 40° C. while maintaining the pAg at 7.2 over 75 minutes to prepare a mono-dispersed emulsion comprising cubic silver chlorobromide grains having an average particle size of 0.28 μm (AgCl content: 70 mol %). Soluble salts were removed in a usual manner, and $5\times10^{-5}$ mol, per mol of silver halide, of sodium thiosulfate was added, followed by ripening at 52.2° C. for 120 minutes. The resulting emulsion was fogged by exposure to fluorescent lighting for 1 minute while stirring. To the fogged emulsion was added the compound shown in Table 3 below. The emulsion was coated on a PET support to a silver coverage of 40 mg per $dm^2$. A gelatin protective layer containing formalin and dimethylolurea as hardening agents was coated thereon to prepare a sample film (hereinafter designated Samples 201 to 207).

Each sample was exposed through a step wedge having density differences of 0.15 to light emitted from a tungsten lamp (color temperature: 2666 K) and adjusted by an LB 200 filter for 100 seconds, developed with Developer 2 having the following formulation at 30° C. for 3 minutes, stopped, fixed, washed with water, and dried. The photographic characteristics of the resulting image are shown in Table 4 below.

Formulation of Developer 2:

| | |
|---|---|
| Metol | 2.5 g |
| Sodium ascorbate (sodium salt of R-1) | 10.0 g |
| Potassium bromide | 1.0 g |
| Sodium metaborate tetrahydrate | 70.0 g |
| Water to make | 1.0 l |
| pH | 10.8 |

TABLE 3

| Sample No. | Compound Added | Amount Added (mmol/mol Ag) | Remark |
|---|---|---|---|
| 201 | none | — | comparison |
| 202 | Comparative Compound (1) | 10 | " |
| 203 | hydrochloride of Compound 2 | 10 | invention |
| 204 | hydrochloride of Compound 13 | 10 | " |
| 205 | hydrochloride of Compound 28 | 10 | " |
| 206 | hydrochloride of Compound 48 | 10 | " |
| 207 | hydrochloride of Compound 64 | 10 | " |

TABLE 4

| Sample No. | Gamma | $D_{min}$ | $D_{max}$ |
|---|---|---|---|
| 201 | no positive image was formed. | | |
| 202 | 4.3 | 0.30 | ≧4 |
| 203 | 18.8 | 0.09 | ≧4 |
| 204 | 16.6 | 0.08 | ≧4 |
| 205 | 14.1 | 0.06 | ≧4 |
| 206 | 17.0 | 0.05 | ≧4 |
| 207 | 12.4 | 0.05 | ≧4 |

As can be seen from Table 4, Samples 203 to 207 containing the nitrogen-containing compound salt according to the present invention exhibited high contrast characteristics having a gamma exceeding 10, while Sample 201 containing no electron acceptor failed to form a positive image and Sample 202 containing a comparative electron acceptor provided a positive image but attained a low contrast.

EXAMPLE 3

A silver nitrate aqueous solution and a potassium bromide aqueous solution containing $3.0\times10^{-7}$ mol, per mol of silver, of sodium hexabromorhodate (III) were added simultaneously to a gelatin aqueous solution kept at 60° C. while maintaining the pAg at 7.0 over 60 minutes to prepare a mono-dispersed emulsion comprising cubic silver bromide grains having an average particle size of 0.20 μm. After soluble salts were removed in a usual manner, $1.95\times10^{-6}$ mol, per ml of silver halide, of chloroauric acid (III) tetrahydrate and $2.44\times10^{-6}$ mol, per mol of silver halide, of formamidinesulfinic acid were added, followed by ripening at 70° C. for 90 minutes to conduct chemical fogging. To the resulting fogged emulsion was added the compound shown in Table 5 below. The emulsion was coated on a PET support to a silver coverage of 40 mg per $dm^2$. A gelatin protective layer containing formalin and dimethylolurea as hardening agents was coated thereon on the film to prepare a sample film (hereinafter designated Samples 301 to 307).

Each sample was exposed to light, developed with the developer 2, stopped, fixed, washed with water, and dried in the same manner as in Example 2. The photographic characteristics of the resulting image are shown in Table 6 below.

TABLE 5

| Sample No. | Compound Added | Amount Added (mmol/mol Ag) | Remark |
|---|---|---|---|
| 301 | none | — | comparison |
| 302 | Comparative Compound (1) | 10 | " |
| 303 | hydrochloride of Compound 2 | 10 | invention |
| 304 | hydrochloride of Compound 13 | 10 | " |
| 305 | hydrochloride of Compound 28 | 10 | " |
| 306 | hydrochloride of Compound 48 | 10 | " |
| 307 | hydrochloride of Compound 64 | 10 | " |

TABLE 6

| Sample No. | Gamma | $D_{min}$ | $D_{max}$ |
|---|---|---|---|
| 301 | no positive image was formed. | | |
| 302 | 5.2 | 0.04 | ≧4 |
| 303 | 22.7 | 0.04 | ≧4 |
| 304 | 20.0 | 0.05 | ≧4 |
| 305 | 22.7 | 0.04 | ≧4 |
| 306 | 30.5 | 0.05 | ≧4 |
| 307 | 13.2 | 0.06 | ≧4 |

As can be seen from Table 6, Samples 303 to 307 containing the nitrogen-containing compound salt according to the present invention exhibited high contrast characteristics having a gamma exceeding 10, while Sample 301 containing no electron acceptor failed to form a positive image and Sample 302 containing a comparative electron acceptor provided a positive image but attained a low contrast. In particular, Samples 303, 304, 305 and 306 provided superhigh contrast positive images having a gamma exceeding 20.

EXAMPLE 4

Each of Samples 301 to 303, 305, and 306 prepared in Example 3 was exposed to light in the same manner as in Example 3, developed with Developer 3, 4, 5, 6 or 7 having the following formulations at 30° C. for 3 minutes, stopped, fixed, washed with water, and dried. The photographic characteristics of the resulting positive are shown in Table 7 below.

Formulation of Developer 3:

| | |
|---|---|
| Sodium ascorbate (sodium salt of R-1) | 10.0 g |
| Sodium carbonate | 26.5 g |
| Sodium sulfite | 60.0 g |
| Potassium bromide | 5.0 g |
| 5-Nitroindazole | 15.5 mg |
| Water to make | 1.0 l |
| pH (adjusted with 10% NaOH aq. soln.) | 12.0 |

Formulation of Developer 4:

| | |
|---|---|
| Sodium ascorbate (sodium salt of R-1) | 10.0 g |
| Hydroquinone | 2.5 g |
| Sodium metaborate tetraydrate | 35.0 g |
| Potassium bromide | 1.0 g |
| 5-Nitroindazole | 14.0 mg |
| Water to make | 1.0 l |
| pH (adjusted with 10% NaOH aq. soln.) | 10.8 |

Formulation of Developer 5:

| | |
|---|---|
| Sodium ascorbate (sodium salt of R-1) | 10.0 g |
| Phenidone | 1.2 g |
| Sodium metaborate tetrahydrate | 35.0 g |
| Potassium bromide | 1.0 g |
| 5-Nitroindazole | 10.0 mg |
| Water to make | 1.0 l |
| pH (adjusted with 10% NaOH aq. soln.) | 10.8 |

Formulation of Developer 6:

| | |
|---|---|
| Sodium ascorbate (sodium salt of R-1) | 10.0 g |
| 1-(p-Hydroxyphenyl)-3-aminopyrazoline | 3.5 g |
| Sodium metaborate tetrahydrate | 35.0 g |
| Potassium bromide | 1.0 g |
| 5-Nitroindazole | 16.0 mg |
| Water to make | 1.0 l |
| pH (adjusted with 10% NaOH aq. soln.) | 10.8 |

Formulation of Developer 7:

| | |
|---|---|
| Sodium ascorbate (sodium salt of R-1) | 10.0 g |
| CD-4* | 4.75 g |
| Sodium metaborate tetrahydrate | 35.0 g |
| Potassium bromide | 1.0 g |
| 5-Nitroindazole | 14.0 mg |
| Water to make | 1.0 l |
| pH (adjusted with 10% NaOH aq. soln.) | 12.0 |

*2-Methyl-4-N-ethyl-N-β-hydroxyethylaniline sulfate monohydrate

TABLE 7

| Run No. | Developer No. | Sample No. | Gamma | $D_{min}$ | $D_{max}$ | Remark |
|---|---|---|---|---|---|---|
| 1 | 3 | 301 | No positive image was formed. | | | comparison |
| 2 | 3 | 302 | 4.8 | 0.04 | ≧4 | " |
| 3 | 3 | 303 | 23.7 | 0.05 | ≧4 | invention |
| 4 | 3 | 305 | 19.3 | 0.05 | ≧4 | " |
| 5 | 3 | 306 | 20.5 | 0.05 | ≧4 | " |
| 6 | 4 | 301 | No positive image was formed. | | | comparison |
| 7 | 4 | 302 | 4.6 | 0.04 | ≧4 | " |
| 8 | 4 | 303 | 17.3 | 0.05 | ≧4 | invention |
| 9 | 4 | 305 | 16.5 | 0.05 | ≧4 | " |
| 10 | 4 | 306 | 18.0 | 0.05 | ≧4 | " |
| 11 | 5 | 301 | No positive image was formed. | | | comparison |
| 12 | 5 | 302 | 5.3 | 0.05 | ≧4 | " |
| 13 | 5 | 303 | 21.2 | 0.07 | ≧4 | invention |
| 14 | 5 | 305 | 18.8 | 0.06 | ≧4 | " |
| 15 | 5 | 306 | 18.0 | 0.08 | ≧4 | " |
| 16 | 6 | 301 | No positive image was formed. | | | comparison |
| 17 | 6 | 302 | 4.5 | 0.12 | ≧4 | " |
| 18 | 6 | 303 | 13.6 | 0.06 | ≧4 | invention |
| 19 | 6 | 305 | 14.0 | 0.06 | ≧4 | " |
| 20 | 6 | 306 | 14.4 | 0.06 | ≧4 | " |
| 21 | 7 | 301 | No positive image was formed. | | | comparison |
| 22 | 7 | 302 | 5.0 | 0.10 | ≧4 | " |
| 23 | 7 | 303 | 12.5 | 0.05 | ≧4 | invention |
| 24 | 7 | 305 | 13.3 | 0.06 | ≧4 | " |
| 25 | 7 | 306 | 14.6 | 0.05 | ≧4 | " |

As in apparent from the results in Table 7, Samples 303, 305 and 306 containing the nitrogen-containing compound salt according to the present invention exhibited high contrast characteristics having a gamma exceeding 10, while Sample 301 containing no electron acceptor formed no positive image when developed with any of Developers 3 to 7, and Sample 302 containing a comparative compound provided a positive image but at a low contrast.

Thus, the present invention makes it possible to provide a high to superhigh contrast positive image.

While the invention has been described in detail and with reference to specific examples thereof, it will be apparent to one skilled in the art that various changes and modifications can be made therein without departing from the spirit and scope thereof.

What is claimed is:

1. A direct positive silver halide photographic material having a pre-fogged silver halide emulsion layer, wherein said pre-fogged silver halide emulsion layer contains a slat of a nitrogen-containing compound containing at least one pyridine nucleus and at least one pyridinium nucleus.

2. A direct positive silver halide photographic material as claimed in claim 1, wherein said salt of a nitrogen-containing compound is a salt of a nitrogen-containing compound in which a pyridine nucleus and a pyridinium nucleus are bonded to each other via a direct bond.

3. A direct positive silver halide photographic material as claimed in claim 1, wherein said salt of a nitrogen-containing compound is a salt of a nitrogen-containing compound in which a quinolinium nucleus or an isoquinolinium nucleus is bonded to a pyridine nucleus via a direct bond.

4. A direct positive silver halide photographic material as claimed in claim 1, wherein said salt of a nitrogen-containing compound is a salt of a nitrogen-containing compound in which a quinoline nucleus or an isoquinoline nucleus is bonded to a pyridinium nucleus via a direct bond.

5. A direct positive silver halide photographic material as claimed in claim 1, wherein said salt of a nitrogen-containing compound is a salt of a nitrogen-containing compound in which a quinolinium nucleus or an isoquinolinium nucleus is bonded to a quinoline nucleus or an isoquinoline nucleus via a direct bond.

6. A direct positive silver halide photographic material as claimed in claim 1, wherein said salt of a nitrogen-containing compound is a salt of a nitrogen-containing compound in which a pyridine nucleus and a pyridinium nucleus are fused together to form a condensed ring.

7. A direct positive silver halide photographic material as claimed in claim 1, wherein said salt of a nitrogen-containing compound is a salt of a nitrogen-containing compound in which a pyridine nucleus and a pyridinium nucleus are fused to one benzene ring to form a condensed ring.

8. A direct positive silver halide photographic material as claimed in claim 2, wherein said salt of a nitrogen-containing compound is a substituted or unsubstituted pyridinium pyridine compound.

9. A direct positive silver halide photographic material as claimed in claim 3, wherein said salt of a nitrogen-containing compound is a substituted or unsubstituted quinolinium pyridine compound.

10. A direct positive silver halide photographic material as claimed in claim 3, wherein said salt of a nitrogen-containing compound is a substituted or unsubstituted isoquinolinium pyridine compound.

11. A direct positive silver halide photographic material as claimed in claim 4, wherein said salt of a nitrogen-containing compound is a substituted or unsubstituted pyridinium quinoline compound.

12. A direct positive silver halide photographic material as claimed in claim 4, wherein said salt of a nitrogen-containing compound is a substituted or unsubstituted pyridinium isoquinoline compound.

13. A direct positive silver halide photographic material as claimed in claim 5, wherein said salt of a nitrogen-containing compound is a substituted or unsubstituted quinolinium quinoline compound.

14. A direct positive silver halide photographic material as claimed in claim 5, wherein said salt of a nitrogen-containing compound is a substituted or unsubstituted isoquinolinium quinoline compound.

15. A direct positive silver halide photographic material as claimed in claim 5, wherein said salt of a nitrogen-containing compound is a substituted or unsubstituted quinolinium isoquinoline compound.

16. A direct positive silver halide photographic material as claimed in claim 5, wherein said salt of a nitrogen-containing compound is a substituted or unsubstituted isoquinolinium isoquinoline compound.

17. A method for forming a high contrast positive image comprising imagewise exposing a direct positive silver halide photographic material having a pre-fogged silver halide emulsion layer, wherein said pre-fogged silver halide emulsion layer contains a salt of a nitrogen-containing compound containing at least one pyridine nucleus and at least oner pyridinium nucleus, and developing the exposed material with an alkaline developer containing a developing agent.

18. A method for forming a high contrast positive image as claimed in claim 17, wherein said reductone compound is a reductone compound.

19. A method for forming a high contrast positive image as claimed in claim 18, wherein said reductone compound is an endiol type reductone compound.

20. A method for forming a high contrast positive image as claimed in claim 18, wherein said reductone compound is an enaminol type reductone compound.

21. A method for forming a high contrast positive image as claimed in claim 18, wherein said reductone compound is a endiamine type reductone compound.

22. A method for forming a high contrast positive image as claimed in claim 18, wherein said reductone compound is a thiol-enol type reductone compound.

23. A method for forming a high contrast positive image as claimed in claim 18, wherein said reductone compound is an enamine-tyiol type reductone compound.

24. A method for forming a high contrast positive image as claimed in claim 19, wherein said endiol type reductone compound is a compound represented by formula (I):

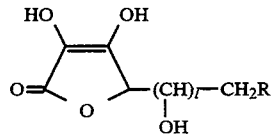

(I)

wherein R represents a hydrogen atom or a hydroxyl group; and l represents an integer of from 0 to 3, or a salt thereof.

25. A method for forming a high contrast positive image as claimed in claim 17, wherein said developing agent is a dihydroxybenzene compound.

26. A method for forming a high contrast positive image as claimed in claim 18, wherein said alkaline developer further contains a dihydroxybenzene compound as an auxiliary developing agent.

27. A method for forming a high contrast positive image as claimed in claim 17, wherein said alkaline developer further contains a 3-pyrazolidone compound as an auxiliary developing agent.

28. A method for forming a high contrast positive image as claimed in claim 17, wherein said alkaline developer further contains a 3-aminopyrazoline compound as an auxiliary developing agent.

29. A method for forming a high contrast positive image as claimed in claim 17, wherein said alkaline developer further contains a p-phenylenediamine compound as an auxiliary developing agent.

30. A method for forming a high contrast positive image as claimed in claim 17, wherein said alkaline developer further contains a p-aminophenol compound as an auxiliary developing agent.

31. A method for forming a high contrast positive image comprising imagewise exposing a direct positive silver halide photographic material having a pre-fogged silver halide emulsion layer, wherein said pre-fogged silver halide emulsion layer contains a salt of a nitrogen-containing compound in which a pyridine nucleus and a pyridinium nucleus are bonded via a direct bond, and developing the exposed material with an alkaline developer containing a reductone compound represented by formula (I):

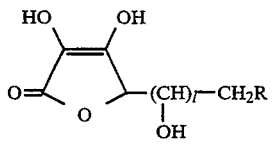

(I)

wherein R represents a hydrogen atom or a hydroxyl group; and l represents an integer of from 0 to 3, or a salt thereof as a developing agent and a p-aminophenol compound as an auxiliary development agent.

32. A method for forming a high contrast positive image comprising imagewise exposing a direct positive silver halide photographic material having a pre-fogged silver halide emulsion layer, wherein said pre-fogged silver halide emulsion layer contains a salt of a nitrogen-containing compound in which a quinolinium nucleus or an isoquinolinium nucleus and a pyridine nucleus are bonded via a direct bond, and developing the exposed material with an alkaline developer containing a reductone compound represented by formula (I):

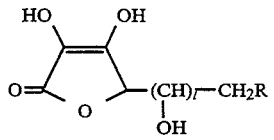

(I)

wherein R represents a hydrogen atom or a hydroxyl group; and l represents an integer of from 0 to 3, or a salt thereof as a developing agent and a p-aminophenol compound as an auxiliary development agent.

33. A method for forming a high contrast positive image comprising imagewise exposing a direct positive silver halide photographic material having a pre-fogged silver halide emulsion layer, wherein said pre-fogged silver halide emulsion layer contains a salt of a nitrogen-containing compound in which a quinoline nucleus or an isoquinoline nucleus and a pyridine nucleus are bonded via a direct bond, and developing the exposed material with an alkaline developer containing a reductone compound represented by formula (I):

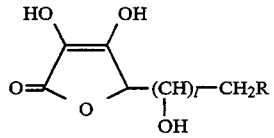

(I)

wherein R represents a hydrogen atom or a hyroxyl group; and l represents an integer of from 0 to 3, or a salt thereof as a developing agent and a p-aminophenol compound as an auxiliary development agent.

34. A method for forming a high contrast positive image comprising imagewise exposing a direct positive silver halide photographic material having a pre-fogged silver halide emulsion layer, wherein said pre-fogged silver halide emulsion layer contains a salt of a nitrogen-containing compound in which a quinolinium nucleus or an isoquinolinium nucleus is bonded to a quinoline nucleus or an isoquinolinium nucleus via a direct bond, and developing the exposed material with an alkaline developer containing a reductone compound represented by formula (I):

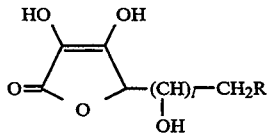

(I)

wherein R represents a hydrogen atom or a hydroxyl group; and l represents an integer of from 0 to 3, or a salt thereof as a developing agent and a p-aminophenol compound as an auxiliary development agent.

35. A method for forming a high contrast positive image comprising imagewise exposing a direct positive silver halide photographic material having a pre-fogged silver halide emulsion layer, wherein said pre-fogged silver halide emulsion layer contains a salt of a nitrogen-containing compound in which a pyridine nucleus and a pyridinium nucleus are fused together to form a condensed ring, and developing the exposed material with an alkaline developer containing a reductone compound represented by formula (I):

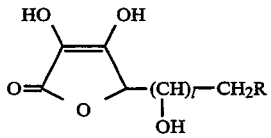

(I)

wherein R represents a hydrogen atom or a hydroxyl group; and l represents an integer of from 0 to 3, or a salt thereof as a developing agent and a p-aminophenol compound as an auxiliary development agent.

36. A method for forming a high contrast positive image comprising imagewise exposing a direct positive silver halide photographic material having a pre-fogged silver halide emulsion layer, wherein said pre-fogged silver halide emulsion layer contains a salt of a nitrogen-containing compound in which a pyridine nucleus and a pyridinium nucleus are fused to one benzene ring to form a condensed ring, and developing the exposed material with an alkaline developer containing a reductone compound represented by formula (I):

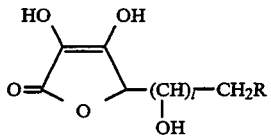

(I)

wherein R represents a hydrogen atom or a hydroxyl group; and l represents an integer of from 0 to 3, or a salt thereof as a developing agent and a p-aminophenol compound as an auxiliary development agent.

* * * * *